US008087143B2

(12) United States Patent
DiPietro

(10) Patent No.: US 8,087,143 B2
(45) Date of Patent: Jan. 3, 2012

(54) METHOD FOR PRODUCING ARMOR THROUGH METALLIC ENCAPSULATION OF A CERAMIC CORE

(75) Inventor: Stephen DiPietro, Mont Vernon, NH (US)

(73) Assignee: Exothermics, Inc., Amherst, NH (US)

( * ) Notice: Subject to any disclaimer, the term of this patent is extended or adjusted under 35 U.S.C. 154(b) by 701 days.

(21) Appl. No.: 12/214,345

(22) Filed: Jun. 18, 2008

(65) Prior Publication Data

US 2011/0220280 A1 Sep. 15, 2011

Related U.S. Application Data

(60) Provisional application No. 60/936,425, filed on Jun. 20, 2007.

(51) Int. Cl.
*B21D 39/00* (2006.01)
*F41H 5/00* (2006.01)

(52) U.S. Cl. ..... 29/458; 29/527.1; 228/193; 89/36.02; 419/49; 109/49.5

(58) Field of Classification Search ..... 29/458, 29/527.1, 527.2, 527.3, 527.5; 228/193; 89/36.02, 36.05; 419/10, 49, 60, 68; 109/49.5, 109/84

See application file for complete search history.

(56) References Cited

U.S. PATENT DOCUMENTS

| | | | | |
|---|---|---|---|---|
| 3,616,115 | A | 10/1971 | Klimmek | |
| 4,667,497 | A | 5/1987 | Oslin | |
| 4,987,033 | A | 1/1991 | Abkowitz | |
| H1434 | H * | 5/1995 | Cytron | 89/36.02 |
| 6,860,186 | B2 * | 3/2005 | Cohen | 89/36.02 |
| 6,995,103 | B2 * | 2/2006 | Aghajanian | 501/88 |
| 7,067,031 | B2 * | 6/2006 | deWitt | 156/250 |
| 7,069,836 | B1 | 7/2006 | Palicka et al. | |
| 7,077,306 | B2 * | 7/2006 | Palicka et al. | 228/170 |
| 7,157,158 | B2 | 1/2007 | Collier et al. | |
| 7,540,228 | B1 * | 6/2009 | Cronin et al. | 89/36.02 |
| 7,603,939 | B2 * | 10/2009 | Cohen | 89/36.02 |
| 7,617,757 | B2 * | 11/2009 | Dickson | 89/36.02 |
| 7,793,579 | B1 * | 9/2010 | Lee | 89/36.02 |
| 2002/0195030 | A1 * | 12/2002 | Christiansen et al. | 109/49.5 |
| 2009/0320676 | A1 * | 12/2009 | Cronin et al. | 89/36.05 |

* cited by examiner

*Primary Examiner* — Jermie Cozart
(74) *Attorney, Agent, or Firm* — Paul C. Remus; Devine, Millimet & Branch

(57) ABSTRACT

A method for the manufacture through diffusion bonding of metallically encapsulated ceramic armor providing enhanced ballistic efficiency and physical durability.

8 Claims, 3 Drawing Sheets

METHOD FOR PRODUCING ARMOR THROUGH METALLIC ENCAPSULATION OF A CERAMIC CORE

CROSS-REFERENCE TO RELATED APPLICATIONS

The present application claims the benefit of provisional patent application Ser. No. 60/936,425 filed Jun. 20, 2007, which is incorporated herein by reference.

FIELD OF THE INVENTION

The present invention relates to metallic encapsulation of lightweight ceramics for use in personnel and vehicular armor systems. More specifically, it relates to metallic encapsulation of lightweight ceramics providing armor with enhanced ballistic efficiency, physical durability, multiple hit capability, structural integrity, and corrosion resistance.

BACKGROUND OF THE INVENTION

State-of-the-art-military armor systems for vehicular and personnel (body armor) protection frequently make use of lightweight, very high compressive strength ceramics such as silicon carbide (SiC), boron carbide ($B_4C$) or alumina as the so-called "strike face" of an armor laminate package. The purpose of the strike face material, as typically employed in high performance ceramic composite armor systems, is to blunt and defeat incoming metallic (often armor-piercing) projectiles by overmatching the compressive properties of the incoming projectile during the early (compressive shock) portions of the impact event. High modulus, high strength ceramics can easily have four to five times the dynamic compressive strength of projectile materials such as steel, tungsten or tungsten carbide. Thus, it is possible to shock the incoming projectile to the extent that compressive fracture is initiated. This decreases the ability of the projectile to defeat the armor system. Additionally, the use of high elastic modulus strike face materials also facilitates radial load spreading of the compressive shock front at the projectile/armor interface; this phenomenon allows lateral engagement of the ceramic to take place, promoting formation of a radially-expanding pulverized (comminuted) zone ahead of and around the impact interface. The combination of load spreading and attendant formation of a comminuted zone comprised of failed ceramic promotes mushrooming of the incoming projectile head and decelerates the projectile as it transits through the ceramic, reducing the intact areal momentum of the projectile and ensuing ceramic fragments. When ceramics are employed in laminate constructions and are backed with high tensile strength, high-toughness "momentum trap" composites such as Kevlar or Spectra fibers, very mass-efficient armor systems can be designed. The mass efficiency of such ceramic composite armor systems is generally two to five times higher than that associated with high hardness steel or similar high strength metallic armor plate.

Over about the past twenty years, it has been discovered that the ballistic performance of ceramic armor is critically dependent on the specific design attributes and geometrical configuration of the entire armor system. In particular, it has been observed that enhanced destruction and fragmentation of an incoming projectile can be obtained by increasing the so-called "dwell" time of the projectile on the front face of the ceramic armor during the very early stages (the first 5-10 microseconds) of the impact event (see Hauver, G. E. et al, L. J., 1994, "Enhanced Ballistic Performance of Ceramics," 19*th Army Science Conference*, Orlando, Fla., June 1994, pp. 1633-1640). In general, the longer the dwell time on the front face, the more completely the projectile can be attenuated and fragmented. Enhanced dwell time on the front face of the ceramic armor leads to a phenomenon that is called interface defeat, wherein the projectile face mushrooms radially outward without significant penetration in the thickness direction; this increases the projectile frontal area and thus decreases its subsequent ability to core a cylindrical plug out of the ceramic armor.

The phenomenon of dwell is used to particular advantage in medium or heavy ceramic armor systems that are intended to defeat larger caliber (12.7 mm and above) high kinetic energy projectiles. It has been found that physical confinement of ceramics such as $B_4C$, SiC or $TiB_2$ delays the lateral and axial spreading of the comminuted zone ahead of the projectile, thus increasing the ballistic efficiency of the ceramic. Physical confinement of ceramic armor tiles can be performed by a number of means, such as by shrink-fitting ceramic tiles or bricks into metallic containers, or by other bonding methods involving the use of welded, bolted, brazed or adhesively bonded metallic containers. Interestingly, for relatively thin armor tiles (less than 0.4-0.5" thick), it has also been found that light lateral or hydrostatic confinement can be of benefit in delaying the flexural failure of armor tiles on the rear face away from a projectile; this effect can also be used advantageously to increase the ballistic efficiency of ceramic armor-based protection systems.

However, ceramic armor is not without serious engineering and practical shortcomings. High hardness, high elastic modulus ceramic materials such as SiC and $B_4C$ are very brittle and have poor durability and resistance to dropping or even rough handling under typical field conditions. Furthermore, the low toughness of high performance ceramics implies that essentially all armor-grade ceramics have poor multiple hit capabilities. Once a large ceramic tile such as a torso plate is impacted with a high velocity rifle round, the subsequent impact response of the armor is seriously compromised. This complicates effective tactical employment and packaging of the ceramic armor because additional composite layers which surround the ceramic have to be especially engineered to contain spill fragments, while also limiting adjacent crack damage to the maximum extent practical. Such measures add cost and weight to ceramic armor systems while not significantly enhancing ballistic performance.

In view of the above, there is a clear need to improve the impact resistance, ballistic efficiency and structural integrity of ceramic armor now employed on a widespread basis in many types of armor systems. One relatively obvious and popular method to overcome the disintegration of ceramic armor is to encapsulate a ceramic armor with a layer of surrounding metal. In the past, such layers have been formed on or around ceramic cores or tiles by techniques such as powder metallurgical-forming, diffusion bonding, and vacuum casting of liquid metal layers.

U.S. Pat. No. 4,987,033, for example, teaches methods for metallic encapsulation of ceramic cores with powdered metal layers that are cold isostatically pressed, vacuum sintered and then hot isostatically pressed to final density. These methods have severe shape limitations, involve the use of relatively costly cold isostatic press tooling, require a complicated and costly multiple step processing sequence, and still require complicated and costly post-machining to produce a metallic encapsulating layer with consistent areal density (which is required for armor system design).

U.S. Pat. Nos. 3,616,115 and 7,069,836 respectively, teach methods for metallic encapsulation of ceramic armor based on vacuum hot pressing and/or diffusion bonding of ceramic tiles and metallic stiffening layers into machined arrays of lattice-type metallic frameworks. While capable of producing well-bonded and geometrically-consistent metallic encapsulation layers, these methods are also costly and very limited with regard to their shape-forming capability and the related ability to be transitioned to large-scale manufacturing, as they require expensive restraint tooling and die sets that essentially limit vacuum hot press or die pressing-based diffusion bonding to flat plate geometries.

Modifications of conventional liquid metal casting processes have also been used as in U.S. Pat. No. 7,157,158. These methods, while capable providing for encapsulation of different ceramic materials as well as complex shapes, require complex and costly molds, and the casting process itself presents many challenges since most metals of interest for encapsulation (Al, Mg, Ti etc.) shrink anywhere from about 3 to 12% upon solidification. The high coefficient of thermal expansion relative to armor-grade ceramics such as silicon carbide, boron carbide or alumina frequently leads to liquid metal casting-based encapsulation results generating very high stresses around the ceramic core—which can easily result in the fracturing of the ceramic being encapsulated. (See Wells, J. M. et al, "Pre-Impact Damage Assessment Using X-Ray Tomography of SiC Tile Encapsulated in Discontinuously Reinforced Aluminum Metal matrix Composite," *ACUN*-3 *International Composites Conference*, February 2001, Sydney, Australia.) This situation would also be worsened for more complex ceramic armor tile geometries, such as would be the case for a body armor torso plate.

Thus, there are still deficiencies with the metallic encapsulation of ceramic cores in the prior art. There is a need to develop metallic encapsulation methods which are less complicated, less costly, capable of working with a wide range of metal and ceramic materials combinations, and also compatible with the requirements of reproducible and large-scale manufacturing. In view of the previous limitations concerning metallic encapsulation of high performance ceramics to produce armor, the objectives of our invention are as follows:

- Enhance multiple hit resistance via metallic encapsulation with metallurgically-bonded layers of metal surrounding ceramic armor tiles and improve the durability and damage tolerance against physical abuse and routine handling for ceramic armor elements by providing a robust metallic container for individual tiles or tile arrays.
- Enhance hydrostatic confinement to increase dwell time for a projectile on the front face, thus promoting mushrooming and defeat of anti-armor projectiles ranging from rifle rounds to high velocity kinetic energy-based anti-tank long rod projectiles.
- Provide for tailorable interfacial bond strength ranging from shear strengths of a <5 MPa to >200 MPa via use of measures such as metallic foil interlayers, thin metallic films, solders, or eutectic-forming braze layers.
- Employ standard, low-cost methods for manufacturing encapsulating layers based on sheet metal and similar metallurgical forming methods and provide methods that are amenable to metallic encapsulation of complex ceramic armor shapes such as torso plates, vehicular door panels or armor vehicle subcomponents.
- Employ highly reproducible methods for diffusion bonding of hundreds or thousands of metallically encapsulated armor tiles in one bonding run, thus significantly enhancing process reproducibility and statistical ballistic response behavior while also reducing unit costs and form metallic layers with highly reproducible and tailorable areal density for weight-sensitive armor systems.
- Provide a method for working with a wide range of encapsulating materials such as titanium, aluminum or magnesium; realizing a reduction of system weight and cost as a result of the having the option hermetically to encapsulate ceramic tiles with widely available, low-cost metals.
- Provide a method for manufacturing individually encapsulated ceramic tiles or tile arrays that can be welded, brazed, mechanically affixed or otherwise bonded to other structural elements or other support members such as would be found on a land vehicle, boat or ship frame, thus simplifying installation and replacement procedures for high performance armor in field settings.
- Provide a method for the manufacture of metallic encapsulated ceramic armor with superior corrosion resistance via use of metals such as Grade 2 titanium, alpha or beta titanium alloys, and/or suitably chosen Al or Mg alloys, thus permitting advantageous use of such armor in marine or similar corrosive atmospheric conditions.

SUMMARY OF THE INVENTION

The present invention relates to methods for the manufacture of diffusion bonded, metallically encapsulated ceramic armor. In a preferred embodiment, the metallically encapsulated ceramic armor made by this method is capable of surviving multiple hits against high velocity anti-armor projectiles with calibers ranging from 0.223" (5.56 mm) to over 1.18" (30 mm) at muzzle velocity with little or no loss in ballistic efficiency after the first impact. It has been found that the present invention leaves largely intact regions of ceramic for cases in which impacts are spaced apart by distances on the order of ten projectile diameters. This represents an improvement of 5× or more in multiple hit capability over other state-of-the-art unencapsulated and polymer or metallically encapsulated ceramic armor systems. The manufacturing process makes use of widely available sheet metal forming methods and isostatic densification equipment, thus a very modest infrastructure for preparing unbonded conformal sheet metal containers and hot isostatic pressurization containers is all that is required to embark on full-scale production.

Even in its basic form, the present invention is further capable of diffusion bonding a wide range of metals (e.g., titanium alloys, aluminum alloys, magnesium alloys, and steels) to ceramics (e.g., alumina, boron carbide, silicon carbide and titanium diboride). For example, Grade 2 titanium or alpha/beta alloys such as Ti-6Al-4V may effectively be solid-state diffusion bonded to silicon carbide or boron carbide using a combined ramp/soak schedule in a hot isostatic press, superplastic forming tool, or similar closed mold assembly which is capable of providing peak temperatures in the vicinity of 850-1100° C. (1560-2012° F.) and peak pressures of approximately 70-100 MPa (10-15 ksi). Aluminum or magnesium alloys such as 5052 Al or 321 Mg may also be solid-state diffusion bonded to silicon carbide or boron carbide using a combined ramp/soak schedule in a hot isostatic press, superplastic forming die set, or similar closed mold assembly which is capable of providing peak temperatures in the vicinity of 550-600° C. (1020-1112° F.) and peak pressures of approximately 35-100 MPa (5-15 ksi).

The present invention produces metallically encapsulated ceramic armor with excellent shear properties and good physical durability. Since the invention in its most basic form involves the use of commercially available sheet metal material for encapsulation, the areal density of the encapsulated armor is extremely repeatable and controllable. It is limited only by the availability of suitable sheet metal products. The articles produced from this invention can also be produced with varying degrees of lateral or hydrostatic confinement by simply varying the thickness and physical properties (i.e., coefficient of thermal expansion, elastic modulus). Other properties such as corrosion resistance and weldability can also be tailored to the engineering requirements of a given system by choosing a suitable pure metal or alloy. For example, metallically encapsulated ceramic armor with excellent corrosion resistance in marine or salt spray environments can be produced by using Grade 2 titanium or suitable alpha or beta titanium alloys as the encapsulating material, thus simplifying maintenance and logistical requirements for the armor system.

It will be understood that the present invention is not limited to being practiced with titanium or aluminum alloys as the encapsulating material. Any metal layer which is thermodynamically compatible with the underlying ceramic tile and which can be formed by standard sheet metal or similar metallurgical forming methods is a potential candidate. Among the metals that could be considered for solid or liquid-phase assisted diffusion bonding as described in this invention disclosure would be titanium, aluminum, magnesium, steel, nickel, tantalum, zirconium or niobium. Solid-state diffusion bonding as described herein is characterized by interatomic or molecular bonding between the mating metal and ceramic surfaces. Intimate contact and bonding, the degree of which can be controlled by suitable application of processing parameter and interphase layers, is brought about via simultaneous combination of applied temperature and pressure. The diffusion bonding conditions needed to bond metallic encapsulating layers to ceramic armor substrates are developed for each materials combination of interest, largely based on factors such as melting point, self-diffusion coefficients, chemical diffusivity and yield stress. If it is found that thermal activation and pressure alone cannot produce a high strength solid-state diffusion bond, active metal (e.g., Ti-, Zr-, Ni-modified) brazes, solders or metallic foils with eutectic melting points lower than the melting point of the metal or ceramic pieces to be joined may be chosen to enhance bonding strength. For instance, eutectic forming 4047-based aluminum alloys may be used to promote transient liquid phase bonding of titanium and/or aluminum alloys to silicon carbide or boron carbide ceramics.

Metallically encapsulated ceramic armor articles formed by the method of the present invention can have tailored thermal expansion and elastic modulus behavior providing for a controllable degree of lateral and/or hydrostatic confinement on the ceramic armor tiles to which they are bonded. This affords the possibility to optimize a given materials system according to the dictates of a given penetration mechanics or finite element structural model.

These and other features and advantages of the present invention will be better understood by reading the following detailed description of a preferred embodiment, taken together with the figures incorporated herein.

DETAILED DESCRIPTION OF THE INVENTION

The present invention is a method for metallic encapsulation of ceramic tiles to produce armor. The embodiment of the method begins with selecting a ceramic tile of the desired geometry, which may include, for example, a flat plate or a torso plate.

Figure 1:
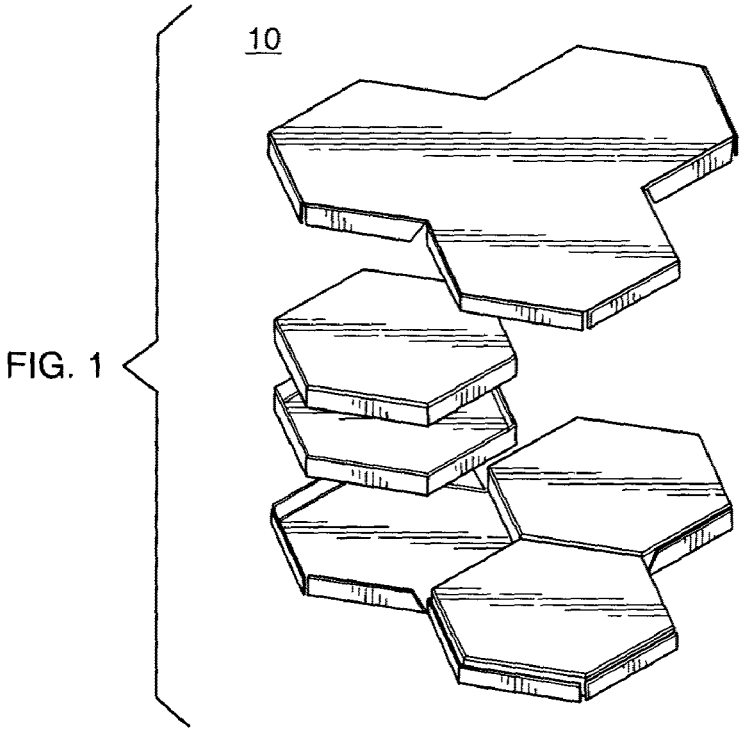
FIG. 1 is a drawing showing the sheet metal forming techniques used to produce (double) encapsulated hexagonal ceramic tile array.

The method then comprises the fabrication of a conformal sheet metal container, wherein suitable sheet or plate stock ranging from 0.005" (0.0127 cm) to 0.250" (0.635 cm) in thickness is made in the shape of the ceramic tile to be encapsulated. The sheet metal envelope can be formed by methods such as brake-forming, shearing, hydroforming, deep drawing, stamping or superplastic forming. The conformal sheet metal container is made with dimensions that are modestly oversized relative to the ceramic tile [+0.005"-0.010" (0.0127-0.0254 cm)] so that the container fits comfortably around the tile, facilitating easy assembly. An example of a sheet metal container design 10 that allows for double encapsulation of individual hexagonally shaped ceramic tiles, as well as a three-tile array, is shown in FIG. 1. This basic design can readily be adapted to different shapes such as rectangular or cylindrical tiles, as forming methods such as brake-forming, automated punching, stamping and spinning may be advantageously employed for fabrication of essentially an infinite variety of sheet metal container shapes. Additionally metallic encapsulation of even larger tile arrays can be done by replicating unit cells of containers that enclose multiple ceramic tiles.

Any suitable metal capable of being plastically formed using standard sheet metal forming techniques is a potential candidate for encapsulation of ceramic tiles to produce armor. Titanium, aluminum, and magnesium alloys have all been successfully employed, and it is obvious to those trained in the art that other metals, such as niobium, tantalum, copper, chromium, nickel and zirconium, would also work well.

The ceramic tile is then placed in the sheet metal container. Typically a full-lap or half-lap joint is applied on the ninety degree portions of the bend, as seen in FIG. 1. Such a fabrication approach provides for full encapsulation of the ceramic tile edges and good lateral confinement of the ceramic tile during impact. Edges are also protected against accidental impact using this container design. For initial fit-up purposes, tack welds using TIG or MIG methods are typically employed at all open corner seams although this is not an absolute necessity for the encapsulation to function successfully. The sheet metal container is then tack-welded to initial closure.

Figure 2:
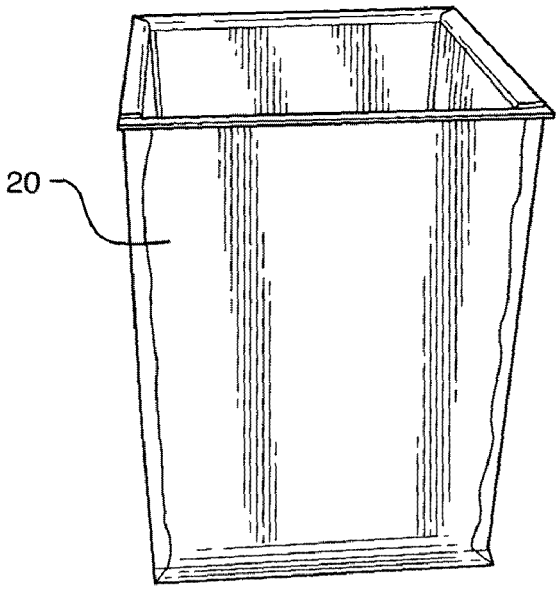
FIG. 2 is a pre-assembly drawing of an isostatic pressurization container.

The closed sheet metal container is then ready for placement into a granular bed that serves as the pressure transmission vehicle to the ceramic tiles in the sheet metal container. An isostatic pressurization container and powder bed is made using a simple, inexpensive box or cylindrical can into which the closed sheet metal container and the granular bed material is placed. The isostatic pressurization container may be constructed of any suitable sheet metal product (e.g., aluminum, steel, titanium, stainless steel) that has a melting point higher than the diffusion bonding temperature of the sheet metal container and the ceramic tile and which is also capable of undergoing reasonable levels of plastic deformation (10-15%). Typical wall thicknesses for the isostatic pressurization container are in the range of 0.040"-0.060" (0.1-0.15 cm). The container is fabricated using the same sheet metal forming and welding methods employed to fabricate the sheet metal container holding the ceramic tile. An example of an isostatic pressurization container 20 is shown in FIG. 2.

The granular bed material needs to be free-flowing and thermodynamically compatible with the isostatic pressurization container and the sheet metal container. Materials such as tabular alumina, dry silica sand, silicon carbide grit, and boron carbide grit, have all been successfully used, with particle size distributions of #40-60 mesh being preferred. Alternatively, ceramic (e.g., alumina or mullite, zirconia, etc.) spheres or microballoons may also be employed as a granular bed material.

When the isostatic pressurization container has been filled to the top with one or more sheet metal containers holding ceramic tiles and granular bed material, a cover is welded to the isostatic pressurization container to effect physical closure. The isostatic pressurization container cover also will have a pump-off and degassing tube connected to it so as to allow for connection of the isostatic pressurization container to a vacuum pump system. The pumping tube should have a diameter of at least ½" (1.27 cm) so that reasonable conductance to the pumping system can be achieved. After being connected to a vacuum system, the isostatic pressurization container and its content are placed into an oven or kiln that permits ramp/soak heating, with slower ramping schedules being used for large isostatic pressurization containers with many sheet metal containers contained within. Roots blower pumping stations are ideally suited for container degassing since they have high throughput over a wide pressure range for a variety of molecular species such as $H_2O$, $CO_2$, etc. These types of vacuum pumping systems are also well suited for complete degassing of very large containers.

When the isostatic pressurization container and its contents of ceramic tiles encapsulated in sheet metal containers and granular bed material have been sufficiently degassed as determined by a residual gas analyzer and vacuum gauge, the isostatic pressurization container is hermetically sealed by hydraulically crimping and then TIG welding the crimped region of the pump-off tube. This operation separates the pump-off tube from the vacuum pumping system while not breaking vacuum, thus ensuring that the a sealed vacuum still exists inside the isostatic pressurization container. The isostatic pressurization container and its contents are then ready for diffusion bonding in a diffusion bonding chamber, which is most typically a hot isostatic press ("HIP") unit. However, the diffusion bonding chamber need not be a HIP. It may be any furnace or closed chamber that is capable of providing isostatic gas pressure to peak pressures of 70-100 MPa (10-15 ksi) and a controlled thermal ramp/soak profile to peak temperatures of approximately 1000° C. (1832° F.) is suitable for diffusion bonding purposes.

A typical diffusion bonding chamber is a HIP that is capable of applying programmable temperature and pressure cycles to any type of sealed container or body which has a gas-tight surface. Very large HIP units having dimensions of 150 cm (60") and 250 cm (100") height are available at locations such as Bodycote IMT, Andover, Mass., for processing of production-sized furnace loads.

The isostatic pressurization container is then subjected to suitable temperature and reserve ramp cycles. Different pressure and temperature ramp cycles are appropriate for direct diffusion bonding of titanium, aluminum and magnesium alloys to materials such as silicon carbide (St. Gobain/Carborundum Hexyloy SA SiC) or hot pressed boron carbide (St. Gobain/Carborundum hot pressed $B_4C$). One such cycle that can be used for direct diffusion bonding of 0.013-0.4 cm (0.005-0.100") thickness alpha or alpha/beta titanium alloy sheet to pressureless-sintered silicon carbide is the following:

| | |
|---|---|
| Step 1: | Purge/pump HIP vessel using standard purge cycle; Pull <500 mTorr (665 mbar) vacuum |
| Step 2: | Initial pressure for start of cycle is 7 MPa (1000 psi) |
| Step 3. | Ramp at 5.5° C./min (10° F./min) to 425° C. (800° F.) while maintaining pressure at 3.5 MPa (500 psi) |
| Step 4: | Hold at 425° C. (800° F.) for 60 minutes at pressure of 3.5 MPa (500 psi) |
| Step 5: | Ramp at 5.5° C./min (10° F./min) to 880° C. (1615° F.) while pressurizing at 0.4 MPa/min (60 psi/min) to 100 MPa (15,000 psi) |
| Step 6: | Hold at 880° C. (1615° F.) for 300 mins while maintaining pressure at 100 MPa (14,750 psi) |
| Step 7: | Cool and release pressure at natural pressure and temperature decay rate for HIP unit |
| Step 8: | Vent and unload once contents are below 177° C. (350° F.) |

Figure 3:
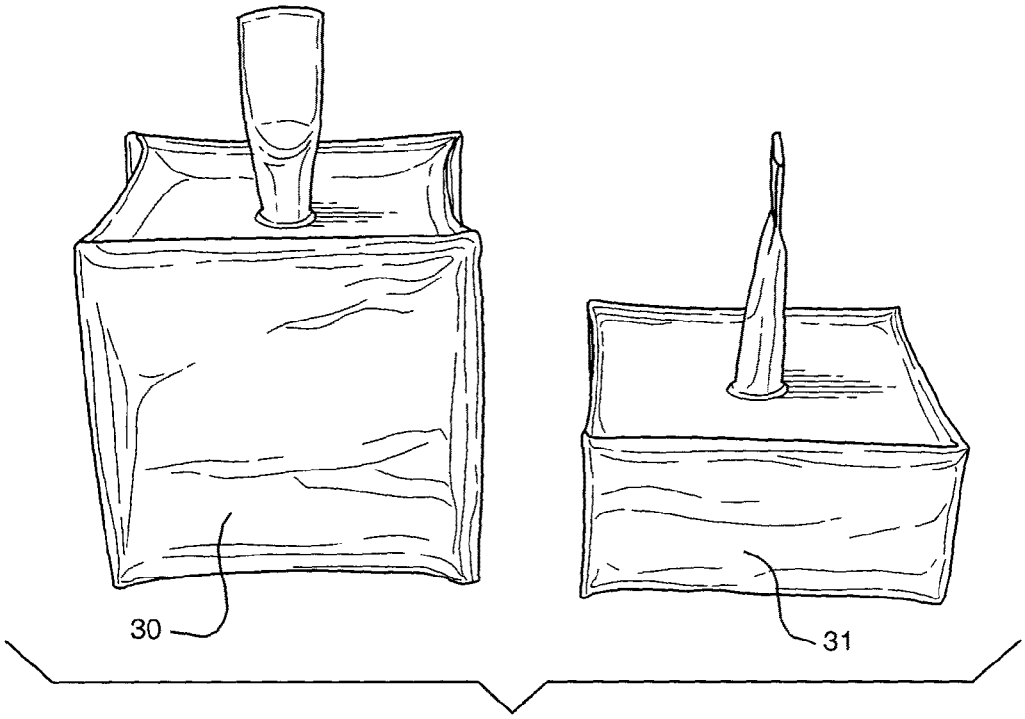
FIG. 3 is a drawing of a post diffusion bonding run of an unopened isostatic pressurization container showing plastic deformation of container walls.
Figure 4:
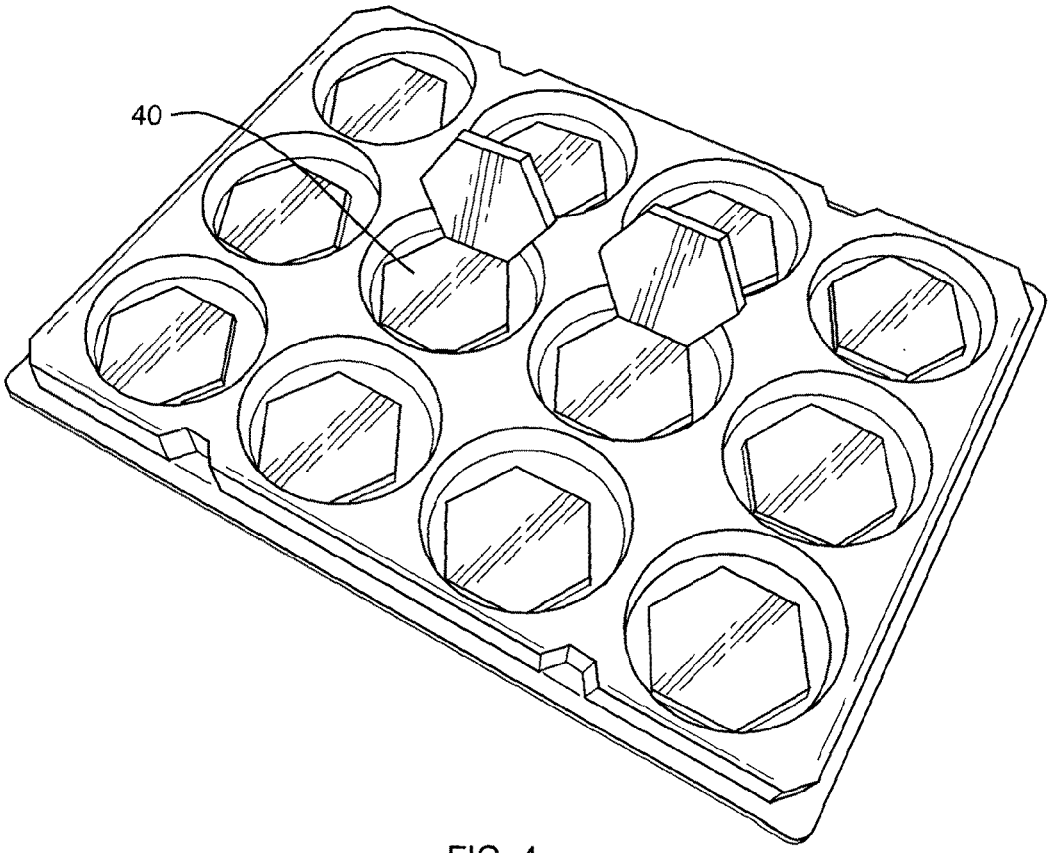
FIG. 4 is a drawing of hexagonal sintered SiC ceramic tiles encapsulated with a single layer of metallurgically bonded 0.010" thick grade 2 titanium layer on all sides.
Figure 5:
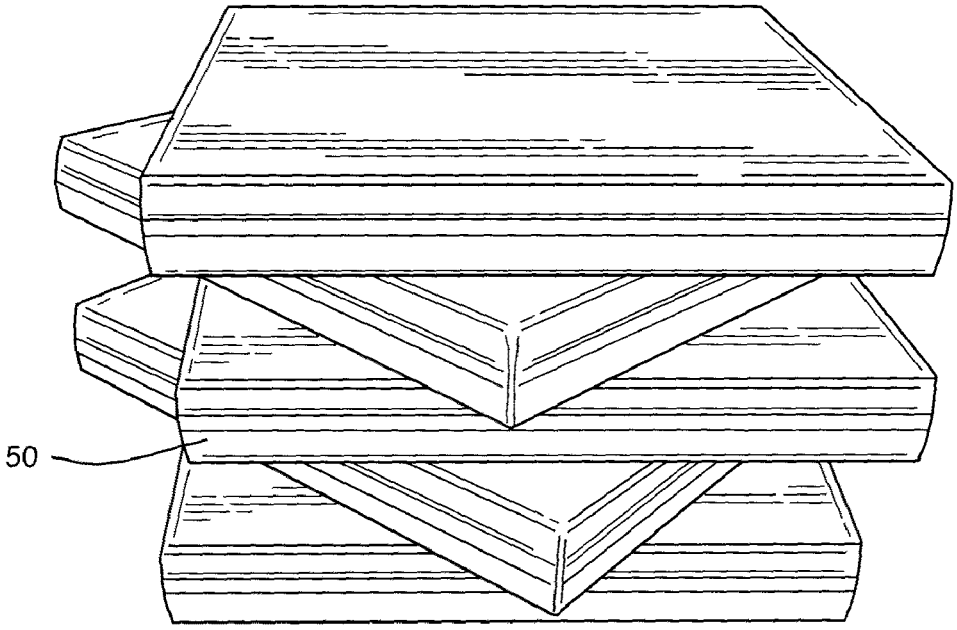
FIG. 5 is a drawing of sintered SiC ceramic tiles encapsulated with a single layer of metallurgically bonded 0.010" thick grade 2 titanium layer on all sides.

After the diffusion bonding pressure/thermal treatment cycle has been completed, the isostatic pressurization container is cut apart and the sheet metal containers holding the ceramic tiles are extracted. A diffusion bond now exists between the sheet metal container and the underlying ceramic tile. Two isostatic pressurization containers 30, 31 after diffusion bonding processing are shown in FIG. 3. Note the evidence of plastic deformation on the container sidewalls. FIGS. 4 and 5, respectively, show a group of hexagonal 40 and square 50 Hexyloy SA SiC tiles that have been encapsulated with 0.05 cm (0.020") Grade 2 Ti sheet. Note the presence of a lap joint of approximately 0.3 cm (0.120") width on the edges of all of the SiC tiles. This ensures good lateral confinement of the tiles, though other types of edge joints can also easily be made such as butt joints or full lap joints.

Figure 6:
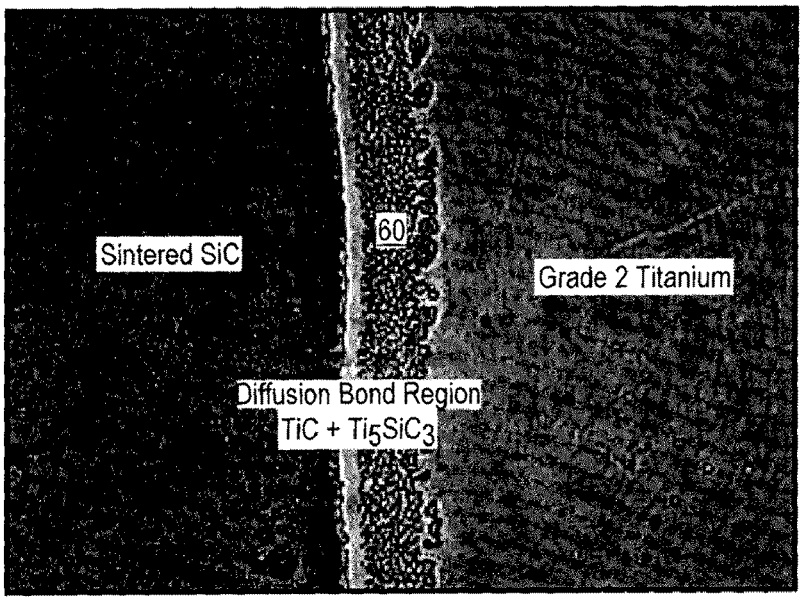
FIG. 6 is an optical micrograph of the interface between sintered SiC and commercial purity (grade 2) titanium showing metallurgical bonding and reaction layer formation.

Metallographic examination of the interface area between the sheet metal container and the ceramic tile, as shown in FIG. 6, shows clear evidence of a metallurgical and chemical, or diffusion, bond 60 between the sintered SiC and Grade 2 titanium that were bonded using the bonding cycle described above. Energy dispersive X-Ray and X-Ray diffraction analyses of the interface region shows that TiC, $Ti_3SiC_2$ and $Ti_5Si_3$ have all formed at the interface, thus indicating that sufficient thermodynamic activity existed during diffusion bonding for interatomic and molecular bonding to occur.

Although the present invention has been described in connection with certain preferred embodiments, those skilled in the art will recognize upon reading the foregoing description that many modification and variations on the basic invention can be employed. For example, though the present invention refers to methods for encapsulation and diffusion bonding of various metals using temperature and pressure as applied in a diffusion bonding chamber, it will be understood that metallic encapsulating layers with other properties of interest such as reversible phase change or dilatancy could also be encompassed within the scope of the present invention, and that such metallic encapsulating layers will require different diffusion bonding parameters according to the types of the ceramic and metals being bonded.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A method of metallically encapsulating a ceramic core to produce armor comprising:

selecting a ceramic tile, fabricating a conformal sheet metal container, placing the ceramic tile in the conformal sheet metal container and closing the conformal sheet metal container, placing the closed conformal sheet metal container and a bed of granular material in an isostatic pressurization container, closing, degassing and hermetically sealing the isostatic pressurization container, subjecting the isostatic pressurization container to temperature and pressure cycles that cause the diffusion bonding of the ceramic tile and the conformal sheet metal container.

2. The method of claim 1 wherein the ceramic tile is comprised of a ceramic selected from the group consisting of alumina, boron carbide, silicon carbide and titanium diboride.

3. The method of claim 1 wherein the conformal sheet metal container is comprised of a metal selected from the group consisting of titanium, aluminum, magnesium, steel, nickel, tantalum, zirconium, and niobium.

4. The method of claim 1 wherein the granular material is comprised of a granular material selected from the group consisting of alumina, silica, silicon carbide and boron carbide.

5. A method of metallically encapsulating a ceramic core to produce armor comprising:

selecting a ceramic tile, fabricating a conformal sheet metal container, placing the ceramic tile in the conformal sheet metal container and closing the conformal sheet metal container, placing the closed conformal sheet metal container and a bed of granular material in an isostatic pressurization container, closing, degassing and hermetically sealing the isostatic pressurization container, placing the isostatic pressurization container in a diffusion bonding chamber, causing the diffusion bonding of the ceramic tile and the conformal sheet metal container.

6. The method of claim 5 wherein the diffusion bonding chamber is a closed chamber capable of providing controlled gas pressures up to peak pressure of 15 ksi and controlled temperatures up to peak temperature of 1000° C.

7. The method of claim 5 wherein the diffusion bonding chamber is a hot isostatic press.

8. A method of metallically encapsulating a ceramic core to produce armor comprising:

selecting a ceramic tile, fabricating a conformal sheet metal container, placing the ceramic tile in the conformal sheet metal container and closing the conformal sheet metal container, placing the closed conformal sheet metal container and a bed of granular material in an isostatic pressurization container, closing, degassing and hermetically sealing the isostatic pressurization container, causing the ceramic tile to be diffusion bonded to the sheet metal container.

* * * * *